United States Patent [19]

Roche et al.

[11] Patent Number: 4,616,156

[45] Date of Patent: Oct. 7, 1986

[54] TRI-MODEL TYPE CIRCUIT BREAKER AND RAPID-START FLUORESCENT LAMP

[75] Inventors: William J. Roche, Merrimac; John W. Anderson, Jr., Ipswich, both of Mass.

[73] Assignee: GTE Products Corporation, Stamford, Conn.

[21] Appl. No.: 817,753

[22] Filed: Jan. 6, 1986

Related U.S. Application Data

[63] Continuation-in-part of Ser. No. 582,672, Feb. 23, 1984, abandoned.

[51] Int. Cl.[4] ..... H05B 39/04

[52] U.S. Cl. ..... 315/107; 315/73; 315/74; 315/106

[58] Field of Search ..... 315/107, 106, 73, 74

[56] References Cited

U.S. PATENT DOCUMENTS

| | | | |
|---|---|---|---|
| 4,097,779 | 6/1978 | Latassa | 315/107 |
| 4,156,831 | 5/1979 | Cassidy et al. | 315/73 |
| 4,510,418 | 4/1985 | Anderson et al. | 315/73 |
| 4,528,479 | 7/1985 | Bonazoli et al. | 315/73 |
| 4,572,986 | 2/1986 | Sindlinger | 315/73 |

*Primary Examiner*—Harold Dixon

*Attorney, Agent, or Firm*—Carlo S. Bessone

[57] ABSTRACT

A rapid-start fluorescent lamp includes a circuit breaker having a pair of electrical conductors sealed into a bulb and connecting a lamp lead to the electrode of the lamp. The circuit breaker includes first and second electrical conductors and a bi-metal strip having a first end portion connected to a first conductor and a second end portion connected to a second conductor at ambient bulb temperature, disconnected therefrom at a higher given range of temperatures, and the portion of the bi-metal strip intermediate the end portions connected to the second electrical conductor at temperatures higher than the given range of temperature.

15 Claims, 6 Drawing Figures

TRI-MODEL TYPE CIRCUIT BREAKER AND RAPID-START FLUORESCENT LAMP

This application is a continuation-in-part, of application Ser. No. 582,672, filed 2/23/84, now abandoned.

CROSS REFERENCE TO OTHER APPLICATIONS

The following applications relate to rapid-start fluorescent lamps and bi-metal type circuit breakers especially suitable to such lamps: U.S. Ser. Nos. 779,314, a continuation of 520,866 now abandoned; 520,865, now U.S. Pat. No. 4,528,479; 706,912, a continuation of 520,863, now abandoned; 520,862; and 817,754, a continuation-in-part of 582,673 now abandoned filed concurrently herewith.

TECHNICAL FIELD

This invention relates to bi-metal type circuit breakers suitable for use with rapid-start fluorescent lamps and more particularly to tri-model or triple-acting bi-metal circuit breakers suitable for enclosure within a rapid-start fluorescent lamp.

BACKGROUND ART

Generally, the two common forms of fluorescent lamps are the so-called "preheat" type or the "rapid-start" type. The preheat type of fluorescent lamp has heater current flow therethrough during lamp ignition and thereafter a voltage-sensitive starter, external of the lamp, opens and discontinues the above-mentioned heater current flow. However, the "rapid-start" type of fluorescent lamp normally has current flow through each electrode not only during ignition but also during the operational period of the lamp. Thus, it can readily be seen that this continuous flow of heater current during operation of the rapid-start lamp is a cause for power loss in the system and an obvious and undesired cause for reduced operational efficiency.

In an effort to improve the energy efficiency of rapid-start fluorescent lamps, numerous suggestions and structural configurations have been suggested. For example, U.S. Pat. Nos. 4,052,687; 4,097,779; 4,114,968; 4,156,831; and 4,171,519 all of which are assigned to the assignee of the present application, provide numerous configurations for enhancing the operation of rapid-start fluorescent lamps. Primarily, each of the above-listed patents relates to rapid-start fluorescent lamps or bi-metal type circuit breakers for fluorescent lamps whereby heater current flow is discontinued during lamp operation.

Although each one of the above-listed structures and techniques enhances and provides numerous advantages over prior known configurations and processes, it has been found that problems remain. More specifically, it has been found that bi-metal type circuit breakers ordinarily require an electrical shunting material short-circuiting the leads of the circuit breaker during the rapid-start fluorescent lamp manufacturing process. During lamp processing, the circuit breaker is subjected to temperatures sufficiently high (about 300° C.) which maintain the circuit breaker open. Since the electrode of the fluorescent lamp includes a coating which requires activation during lamp manufacture, it is necessary for the electrode to be electrically heated by electrode current therethrough during this time. Therefore, it has been found necessary to provide a means for essentially removing the circuit breaker effect from the structure, (e.g., by short-circuiting) until after the emissive material of the electrode has been activated.

In order to accomplish the above-mentioned emissive material activation, the above-described electrical shunt is short-circuited across the circuit breaker to permit current flow to the electrode. However, once the emissive materials on the electrode have been processed it is necessary to remove the electrical shunt and re-activate the bi-metal circuit breaker employed with the rapid-start fluorescent lamp.

Although such structures have been and still are employed with relatively good results, it has been found that a circuit breaker wherein an electrical shunt is required does present problems of extra materials, added labor, increased defects and reduced productivity all of which increases cost and reduces manufacturing efficiency. Moreover, lamp processing introduces numerous oxidation problems associated with correct attaching of the shunt material.

OBJECTS AND SUMMARY OF THE INVENTION

An object of the present invention is to provide an enhanced bi-metal type circuit breaker. Another object of the invention is to provide an improved rapid-start fluorescent lamp. Still another object of the invention is to provide an enhanced rapid-start fluorescent lamp having increased efficiency. A further object of the invention is to provide a bi-metal type circuit breaker which is simple and inexpensive to manufacture and requires neither the presence or removal of a shunting material short-circuiting the circuit breaker electrical conductors.

These and other objects, advantages and capabilities are achieved in one aspect of the invention by a circuit breaker having first and second electrical conductors sealed into and passing through a bulb with a bi-metal strip having first and second end portions separated by an intermediate portion with the first end portion affixed to the first electrical conductor, the second end portion formed to contact the second electrical conductor, at ambient bulb temperature, to be spaced therefrom at a given range of bulb temperature and to contact said first electrical conductor at temperatures higher than the given range of bulb temperatures and the intermediate portion formed to contact the second electrical conductor at bulb temperatures higher than the given range of bulb temperatures.

In another aspect, a rapid-start fluorescent lamp includes an envelope having a phospor-coated inner wall surface, a pair of spaced electrodes within the envelope, a pair of electrical leads sealed into each end of the envelope and a circuit breaker within each end of the envelope coupling one of the electrical leads to an electrode with the electrode directly connected to the other electrical lead wherein the circuit breaker includes first and second electrical conductors sealed into a bulb, a bi-metal strip having a first end portion affixed to the first electrical conductor, a second end portion formed to contact said second electrical conductor at ambient temperatures, be spaced therefrom at a higher given range of temperature and to contact said first electrical conductor at temperatures higher than the given range of temperatures and the intermediate portion formed to contact the second electrical conductor at bulb temperatures higher than the given range of bulb temperature.

BEST MODE FOR CARRYING OUT THE INVENTION

For a better understanding of the present invention, together with other and further objects, advantages, and capabilities thereof, reference is made to the following disclosure and appended claims taken in conjunction with the above-described drawings.

Figure 1:
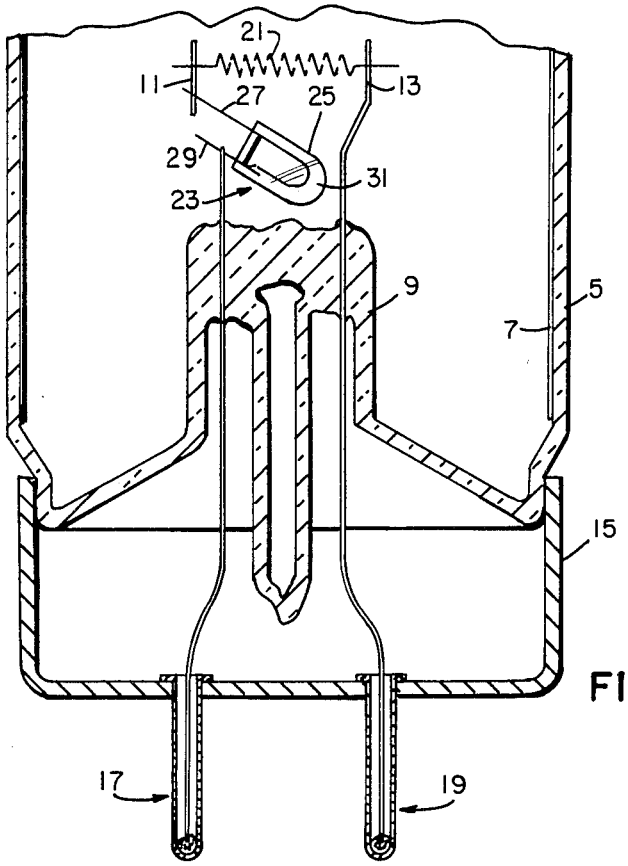
FIG. 1 is an elevational view, partially in section, of one end of a rapid-start fluorescent lamp employing a tri-model circuit breaker.

Referring to FIG. 1 of the drawings, a rapid-start fluorescent lamp includes an elongated glass envelope 5 having a coating of phosphors 7 on the inner wall surface of the envelope 5. A glass stem member 9 is sealed into the end of the envelope 5 and includes a pair of electrical leads 11 and 13 sealed therein and passing therethrough. An end cap 15 is telescoped over and attached to the end of the glass envelope 5 and includes a pair of pins 17 and 19 electrically connected to a portion of the electrical leads 11 and 13 and formed to provide electrical connection to an external source (not shown). Moreover, the envelope 5 has a gas fill therein selected from the group consisting or argon, krypton, neon, helium and combinations thereof.

An electrode 21 is located within the envelope 5 and connected at opposite ends to the electrical leads 11 and 13. Thus, the longitudinal axis of the electrode 21 is in a direction substantially normal to the direction of the electrical leads 11 and 13. Moreover, this electrode 21, which is frequently referred to as a filament or cathode, is of a well known type used in rapid start fluorescent lamps and usually includes a tungsten coil having a coating thereon in the form of alkaline earth oxides which were applied in the form of carbonates and processed to provide the oxides.

Disposed within the envelope 5 is a circuit breaker 23. The circuit breaker 23 is preferably in the form of a glass bulb or bottle 25 having a press seal at one end thereof. A pair of electrical conductors 27 and 29 are sealed into and pass through the press seal of the glass bulb 25. Also, a thermally-sensitive bi-metal 31 is positioned within the glass bottle 25 with one end thereof attached to one of the electrical conductors 27 and the opposite end of the bimetal 31 contacting the other electrical conductor 29. Moreover, the electrical conductors 27 and 29 extending outwardly of the glass bulb 25 are connected to the base pin 17 and to the electrical lead 11 respectively with the electrical lead 11 also connected to one end of the electrode 21.

Figure 2:
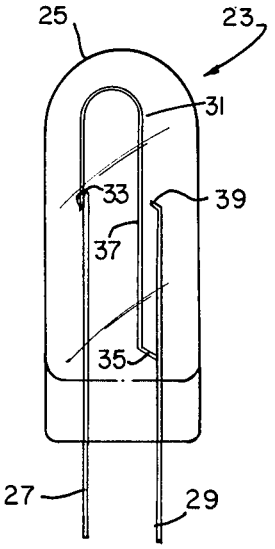
FIG. 2 is a cross-sectional view of an embodiment of a tri-model circuit breaker.

Referring more specifically to the circuit breaker 23, FIG. 2 illustrates a preferred embodiment of a tri-model circuit breaker configuration. Herein, a sealed glass bulb 25 includes a first and second electrical conductor, 27 and 29 respectively, sealed therein and passing therethrough. A thermally-sensitive bi-metal strip 31 is disposed within the bulb 25 and includes a first end portion 33, a second end portion 35 and an intermediate portion 37 between the first and second end portions 33 and 35.

The first end portion 33 of the bi-metal strip 31 is affixed to the first electrical conductor 27 in a manner whereby the end of the first electrical conductor 27 serves as a fulcrum for effecting the desired bending of the bi-metal strip 31. The second end portion 35 is formed for electrical contact and preferably "edge-contact" with the second electrical conductor 29. Also, the second electrical conductor 29 has a formed end 39 of a configuration suitable for "edge-contact" with the intermediate portion 37 of the thermally-sensitive bi-metal strip 31.

Figure 3:
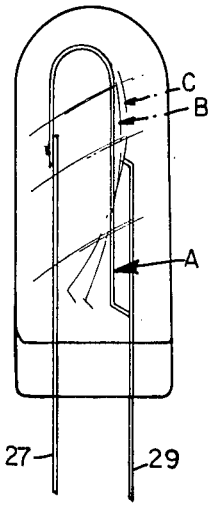
FIG. 3 illustrates the operational configurations of the embodiment of FIG. 2.

As can more readily be seen in the operational configuration of FIG. 3, the thermally-sensitive bi-metal strip 31 is formed such that the second end portion 35 contacts the second electrical conductor 29 at an ambient bulb temperature such as a temperature of about 25° C. for example (Condition A). As the bulb temperature is increased to a given range of bulb temperatures, of about 100° to 180° C. for example during the operational period of the lamp, the bi-metal strip 31 is deflected such that neither the second end portion 35 nor the intermediate portion 37 are in contact with either second electrical conductor 29 or formed end contact 39 (Condition B). Moreover, as the temperature of the bulb 25 is increased to a temperature higher or greater than the given range of bulb temperatures during the lamp manufacturing process, as for example a temperature of about 300° C., the thermally-sensitive bi-metal strip 31 is further deflected (Condition C) whereupon the intermediate portion 37 contacts the second electrical conductor 29 at end contact 39 in order to permit current flow for activation of the emissive materials of the electrode.

Accordingly, a tri-model circuit breaker for use in a rapid-start fluorescent lamp has been provided wherein three operational modes are attainable. A first mode (Condition A) wherein the bulb is in at an ambient temperature and the bi-metal provides electrical contact between first and second electrical conductors. A second mode (Condition B) wherein the bulb is at a higher given range of temperatures, a fluorescent lamp operational temperature, and there is no contact between the first and second electrical conductors and no heater current flows to the electrode. Also, a third operational mode (Condition C) wherein the first and second electrical conductors are again in contact at a higher bulb temperature whereby activation of the potentially electron emissive materials of the cathode may be effected during the manufacturing process.

Figure 4:
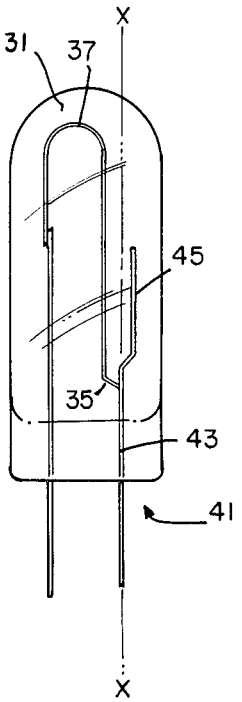
FIG. 4, 5, and 6 are alternate embodiments of the tri-model circuit breaker of FIG. 2.
Figure 5:
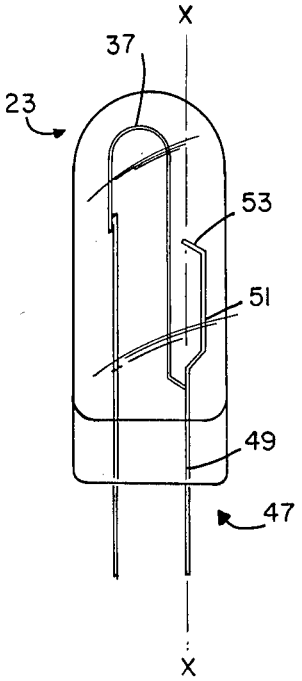
Figure 6:
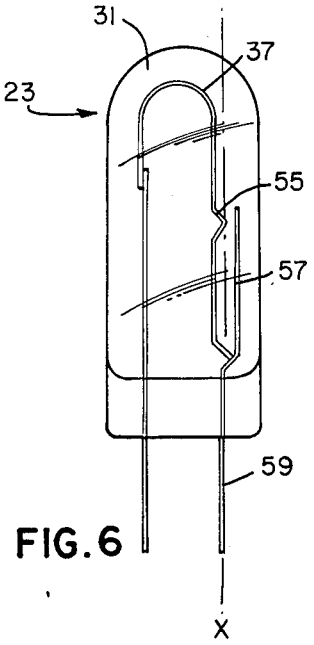

Additionally, numerous alternative embodiments are readily attained as illustrated in FIGS. 4 through 6. In FIG. 4, for example, a second electrical conductor 41 has a longitudinal axis X-X' with a portion 43 thereof extending along the axis X-X' and another portion 45 normally off-set from the axis X-X'. Accordingly, the second end portion 35 of the bi-metal strip 31 contacts the one portion 43 of the conductor 41 while the intermediate portion 37 of the bi-metal 31 contacts the normally off-set portion 45.

Also, FIG. 5 illustrates a circuit breaker 23 wherein the second electrical conductor 47 has a first portion 49 extending along a longitudinal axis X-X', a second off-set portion 51 and an end portion 53 formed for "edge contact" with the intermediate portion 37 of a bi-metal strip 31. Moreover, FIG. 6 illustrates still another embodiment wherein the intermediate portion 37 of a bi-metal strip 31 includes a bump 55 which is formed for contact with an off-set portion 57 of a second electrical conductor 59.

It may be noted that the above-described circuit breaker configuration and rapid-start fluorescent lamps utilizing such circuit breaker configurations are not only more easily manufactured than circuit breakers and lamps wherein shunting of the bi-metal strip was necessary but are also more economical of components and assembly time. Moreover, testing of the circuit breaker is enhanced with the above-described improved structure since the shunting mechanism resistance does not interfere with the measurement of the capsule contact resistance.

While there have been shown what are at present considered to be preferred embodiments of the invention, it will be apparent to those skilled in the art that various changes and modifications can be made herein without departing from the scope of the invention as defined by the appended claims.

We claim:

1. A tri-model circuit breaker for use in a rapid-start fluorescent lamp comprising:

a glass bulb;

first and second electrical conductors sealed into and passing through said bulb; and a thermally sensitive electrically conductive bi-metal strip disposed within said bulb and having first and second end portions separated by an intermediate portion, said first end portion being affixed to said first electrical conductor, said second end portion being formed to contact said second electrical conductor at ambient bulb temperatures, to be spaced from said second electrical conductor at a given range of bulb temperatures higher than said ambient bulb temperature, and said intermediate portion of said bi-metal strip being spaced from said second electrical conductor at ambient and at said given range of bulb temperatures and contacting said second electrical conductor at bulb temperature higher than said given range of bulb temperatures whereby said first and second electrical conductors are electrically connected at ambient temperature and at bulb temperatures higher than said given range of temperatures.

2. The circuit breaker of claim 1 wherein said envelope is a hermetically sealed glass envelope.

3. The circuit breaker of claim 1 wherein said second electrical conductor has an end portion formed for edge contact with said intermediate portion of said bi-metal strip.

4. The circuit breaker of claim 1 wherein said second end portion of said bi-metal strip is formed for edge contact with said second electrical conductor.

5. The circuit breaker of claim 1 wherein said given range of bulb temperature higher than said ambient bulb temperature is a range of about 100° to 180° C.

6. The circuit breaker of claim 1 wherein said bulb temperature higher than said given range of bulb temperatures is about 300° C.

7. The circuit breaker of claim 1 wherein said ambient bulb temperature is a temperature of about 25° C.

8. The circuit breaker of claim 1 wherein said second electrical conductor has a longitudinal axis extending parallel to said first electrical conductor, a first portion sealed into and passing through said envelope and extending along said longitudinal axis and a second portion affixed to and off-set from said longitudinal axis of said first portion and formed for contact with said intermediate portion of said first electrical conductor.

9. A rapid-start fluorescent lamp comprising:

a glass envelope having a phosphor-coated inner wall surface;

a pair of spaced electrodes positioned within the ends of said envelope;

a pair of electrical leads sealed into each end of said envelope and formed for connection to an external energizing source with one of said electrical leads directly connected to an electrode and;

a circuit breaker disposed within each end of said envelope with said circuit breaker coupling the other one of said pair of electrical leads to said electrode, said circuit breaker including first and second electrical conductors sealed into and passing through a glass bulb, a thermally sensitive bi-metal strip having first and second end portions separated by an intermediate portion disposed within said bulb, said first end portion of said bi-metal strip affixed to said first electrical conductor, said intermediate portion being spaced from said second electrical conductor at ambient and at a higher given range of bulb temperatures and contacting said second electrical conductor at bulb temperatures higher than said given range of bulb temperatures, and said second end portion contacting said second electrical conductor at ambient bulb temperatures, spaced therefrom at said given range of bulb temperatures, said bulb temperatures higher than said given range of bulb temperatures occurring during the manufacturing process of said fluorescent lamp.

10. The rapid-start fluorescent lamp of claim 9 wherein said given range of bulb temperature of said circuit breaker is a range of about 100° to 180° C.

11. The rapid-start fluorescent lamp of claim 9 wherein said second end portion of said bi-metal strip is formed for contact with said second electrical conductor.

12. The rapid-start fluorescent lamp of claim 9 wherein said second electrical conductor of said circuit breaker is formed for edge contact with said intermediate portion of said bi-metal strip.

13. The rapid-start fluorescent lamp of claim 9 wherein said bulb temperature higher than said given range of bulb temperatures of said circuit breaker is about 300° C.

14. The rapid-start fluorescent lamp of claim 9 wherein said second end portion of said bi-metal strip and said second electrical conductor of said circuit breaker are each formed for edge contact with said second electrical conductor and said bi-metal strip respectively.

15. The rapid-start fluorescent lamp of claim 9 wherein said second electrical conductor of said circuit breaker has a longitudinal axis and a portion of said second electrical conductor off-set from said longitudinal axis within said glass bulb, said off-set portion of said second electrical conductor formed for electrical contact with said intermediate portion of said bi-metal strip.

* * * * *